United States Patent [19]

Watanabe

[11] Patent Number: 5,059,973

[45] Date of Patent: Oct. 22, 1991

[54] INK JET HEAD FORMED BY BONDING A DISCHARGE PORT PLATE TO A MAIN BODY

[75] Inventor: Takashi Watanabe, Yokohama, Japan

[73] Assignee: Canon Kabushiki Kaisha, Tokyo, Japan

[21] Appl. No.: 473,824

[22] Filed: Feb. 2, 1990

[30] Foreign Application Priority Data

Feb. 3, 1989 [JP] Japan ..... 1-025547

[51] Int. Cl.[5] ..... B41J 2/14; B41J 2/05; B41J 2/165

[52] U.S. Cl. ..... 346/1.1; 346/140 R

[58] Field of Search ..... 346/140, 1.1

[56] References Cited

U.S. PATENT DOCUMENTS

| | | | |
|---|---|---|---|
| 4,057,807 | 11/1977 | Fischbeck | 346/140 |
| 4,296,421 | 10/1981 | Hara et al. . | |
| 4,313,124 | 1/1982 | Hara . | |
| 4,345,262 | 8/1982 | Shirato et al. . | |
| 4,450,455 | 5/1984 | Sugitani | 346/140 |
| 4,459,600 | 7/1984 | Sato et al. . | |
| 4,463,359 | 7/1984 | Ayata et al. . | |
| 4,558,333 | 12/1985 | Sugitari et al. . | |
| 4,707,705 | 11/1987 | Hara | 346/140 X |
| 4,723,129 | 2/1988 | Endo et al. . | |
| 4,723,131 | 2/1988 | Droit | 346/140 X |
| 4,730,196 | 3/1988 | Esdonk | 346/140 |
| 4,740,796 | 4/1988 | Endo et al. . | |
| 4,894,664 | 1/1990 | Pan | 346/140 X |

FOREIGN PATENT DOCUMENTS

| | | |
|---|---|---|
| 59-123670 | 7/1984 | Japan . |
| 59-138461 | 8/1984 | Japan . |
| 230949 | 10/1986 | Japan . |
| 242546 | 10/1987 | Japan . |

*Primary Examiner*—Joseph W. Hartary

*Attorney, Agent, or Firm*—Fitzpatrick, Cella, Harper & Scinto

[57] ABSTRACT

An ink jet head main body includes an opening provided corresponding to a discharge port, an ink pathway communicated to the opening, and an energy generating member for generating energy to be utilized for discharging ink from the discharge port. The main body is bonded to a discharge port plate, through which the discharge port is located. A method of making the ink jet head includes a bonding step of bonding the member which becomes the discharge port plate to the face of the ink jet head main body where the opening is provided; a pressurizing step of applying pressure to the portion of the discharge port plate which becomes the discharge port; and a discharge port forming step of forming the discharge port on the member which becomes the discharge port plate.

18 Claims, 4 Drawing Sheets

INK JET HEAD FORMED BY BONDING A DISCHARGE PORT PLATE TO A MAIN BODY

BACKGROUND OF THE INVENTION

1. Field of the Invention

This invention relates to an ink jet head which performs recording by jetting liquid to form flying droplets, a method for preparing the head, and an orifice plate provided with discharge ports (orifices) for jetting liquid which is equipped on the head.

2. Related Background Art

An ink jet recording head is constituted basically of a discharge port plate, the so called orifice plate, having discharge ports for ink (orifices), a ceiling plate having concavities for forming ink pathways communicated with the respective orifices, and a substrate constituting a part of the liquid pathways and having an energy generating member which generates energy to be utilized for discharging ink.

The orifice for discharging ink affects discharge speed and discharge direction of the ink droplets, and therefore its precision, shape and the like are important. Above all, the shape of the portion where the liquid pathway and the orifice are communicated with each other and the shape of the orifice should be desirably determined so as to make the ink flow smoothly. However, in the ink jet recoding head according to the background art, the schematic sectional view of which is shown in FIG. 2, the following problems occurred in some cases. That is, because the sizes of the liquid pathway and the orifice are different at the communicated portion of the liquid pathway 6 and the orifice 5, the flow of ink is not smooth, which reduces the discharging speed. This causes the problem that the discharging speed is lowered to worsen the precision of shooting points, leading sometimes to deterioration of printing quality. Also, the shape of the orifice should be preferably such that it is tapered, becoming gradually narrowed toward the tip end, for improving discharging performance, but it has been also difficult to apply such working on the fine orifices of an ink jet recording head having an orifice plate with a small thickness.

SUMMARY OF THE INVENTION

The present invention has been accomplished in view of the problems as mentioned above, and one of its objects is to provide an ink jet recording head in which the liquid pathway and the orifice are in contact with each other in a reasonable shape, and also the orifice has a tapered shape, and a simple method for preparing the same.

Another object of the present invention is to provided a process for preparing an ink jet head having a discharge port plate having a discharge port for discharging ink provided thereon, and an ink jet head main body having an opening provided corresponding to said discharge port and an ink pathway communicated to said opening and having an energy generating member for generating energy to be utilized for discharging ink from said discharge port, wherein said main body is bonded to said discharge port plate. The method includes:

the bonding step of bonding the member which becomes said discharge port plate to the face of said ink jet head main body where said opening is provided;

the pressurizing step of applying a pressure on the portion of said discharge port plate which becomes said discharge port; and the discharge port forming step of forming said discharge port on the member which becomes said discharge port plate.

Still another object of the present invention is to provide an ink jet head comprising a discharge port plate having a discharge port for discharging ink provided thereon, and an ink jet head main body comprising an opening provided corresponding to said discharge port and an ink pathway communicated to said opening and having an energy generating member for generating energy to be utilized for discharging ink from said discharge port, said main body being bonded to said discharge port plate, wherein said discharge port plate has its main body portion shaped in a film, and a part thereof intrudes into said opening of said ink jet head main body.

Yet another object of the present invention is to provide a discharge port plate for an ink jet head comprising a discharge port for discharging ink provided thereon, wherein the main body portion of said plate being shaped in a film, and wherein the portion of said discharge port of said plate protruding from said main body portion.

DESCRIPTION OF THE PREFERRED EMBODIMENTS

Specific examples of the present invention are shown below.

Figure 1:
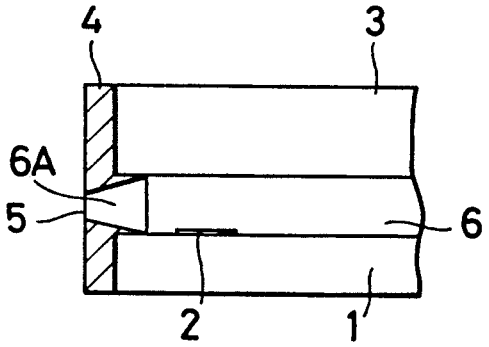
FIG. 1 is a schematic sectional view showing an example of the liquid pathway portion of an ink jet recording head according to the present invention.
Figure 2:
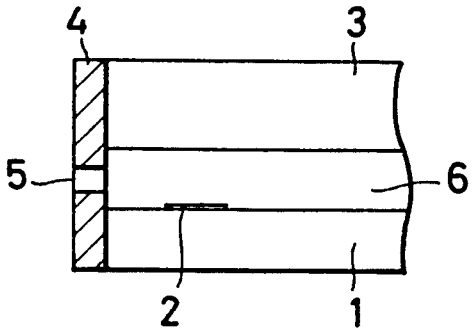
FIG. 2 PRIOR ART
FIG. 2 is a sectional view showing an example of the liquid pathway portion of an ink jet recording head according to the background art.

FIG. 1 is a schematic sectional view representing well the specific features of the present invention and, in the same Figure, 1 is the substrate constituting a part of ink pathways, 2 is an energy generating member provided on the substrate 1, 3 is a grooved ceiling plate having grooves (concavities) for forming ink pathways, 4 is an orifice plate, and 5 is an orifice.

Figure 3:
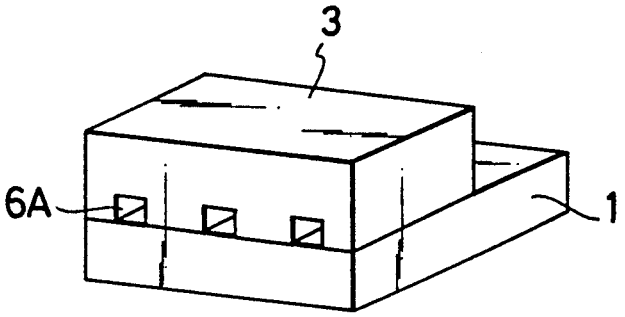
FIG. 3 is a schematic perspective view showing the head main body having a ceiling plate and a substrate bonded together.
Figure 4:
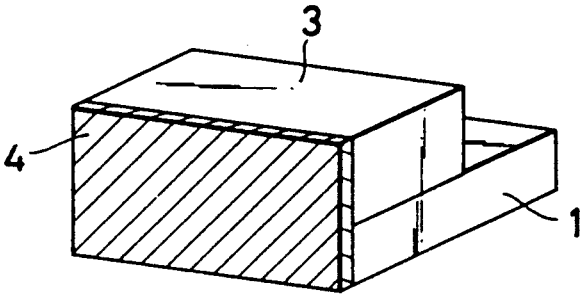
FIG. 4 is a schematic perspective view showing the state having an orifice plate bonded to the head main body.
Figure 5:
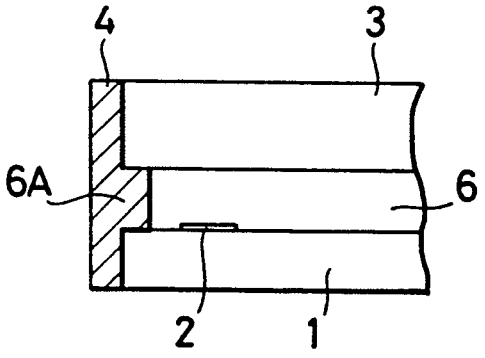
FIG. 5 is a schematic sectional view showing the liquid pathway portion in FIG. 4.

Next, by referring to the preparation method of the present invention, the specific features of the present invention are described. First, as shown in FIG. 3, the grooved ceiling plate 3 for formation of liquid pathways and the substrate 1 are bonded to form openings 6*a* communicated to the liquid pathways 6. Next, a dry film (trade name: SE-320 mfd. by Tokyo Oka, 20–30 μm in thickness) which is a thermoplastic resin is bonded as the material for the orifice plate. In bonding, after a polyethylene (PE) film which is the protective film of the dry film is peeled off, the dry film is heated to about 60° C. The dry film sufficiently heated is softened by heat. Under such state, the dry film is pressure adhered onto the head main body having the grooved ceiling plate for formation of liquid pathways and the substrate bonded together in FIG. 3. During that operation or thereafter, pressure is applied particularly on the portion which becomes the orifice. FIG. 4 shows the state of the dry film bonded to the head main body, and FIG. 5 a schematic sectional view of the portions which become the liquid channel and the orifice. As can be seen from FIG. 5, the dry film sufficiently softened protrudes to enter internally of the liquid pathway. Next, by utilizing the characteristics of the dry film which is a photosensitive resin, by use of a photomask necessary for the diameter of the orifice tip end, the orifice 5 (25–35 μm in diameter) communicated to the liquid pathway 6 is formed by working according to the photolithographic steps by exposure and developing. At this time, by varying the exposure time, the taper angle of the orifice can be varied.

By employment of the method as described above, an orifice in a tapered shape communicated to the liquid pathway can be simply obtained.

In the following, another example of the present invention is described.

Figure 6:
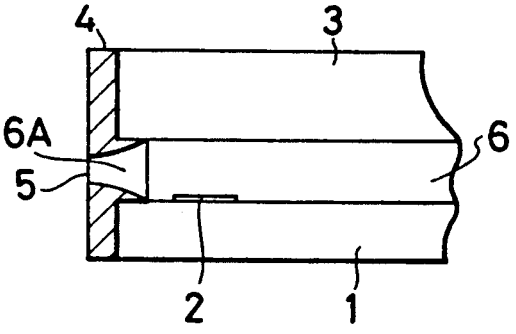
FIG. 6 is a schematic sectional view showing another example of the liquid pathway portion of an ink jet head according to the present invention.

First, the substrate 1 and the grooved ceiling plate 3 for formation of liquid pathways are bonded together, and a dry film is bonded as the orifice plate, similarly as practiced in the foregoing example. In this example, the bonded dry film is subjected to UV curing. Next, by use of a mask necessary for the diameter of the tip end of the orifice similarly as in the foregoing example, the orifice is worked by an excimer laser (strength: 200–1000 $mJ/cm^2$). At this time, by the angle of the laser beam, a tapered orifice is obtained. Also, depending on the material of the orifice plate and the working conditions of the laser, an orifice the section of which draws a parabolic line as shown in FIG. 6 can be also obtained.

In the case of forming orifices by use of an excimer laser, in addition to the above-described dry film, an organic resin material which is softened by heating can be also used.

Also, as the energy generating element of the ink jet recording head of the present invention, an electrothermal transducer which generates heat energy to be utilized for discharging ink can be used. This case is also suitable for miniaturization of the whole recording head, and higher density arraying of discharge ports, and can very preferably exhibit fully the effects of the present invention.

Further, having shown examples of the ink jet head main body formed by bonding a ceiling plate with concavities for formation of ink pathways in a substrate with the concavities being on the inner side thereby forming the ink pathways and openings communicated to the ink pathways in the foregoing examples, the formation of the ink jet head main body is not limited to this mode. That is, the ink jet head main body may be formed by any mode, provided that it has ink pathways to be communicated to the discharge ports provided on the orifice plate, and openings for intrusion of a part of the orifice plate into the ink pathways are provided. For example, the ceiling plate having the concavities for forming the ink pathways in the examples as described above may be formed of either one member or separate members for the side wall portion and the ceiling portion of the ink pathway.

In addition, the main body portion of the orifice plate according to the present invention should be preferably one shaped in a film (flat plate shape) as described above, preferably with the form covering over all the surface where the openings of the head main body are provided. The reason is that wiping action of the orifice portion or aspiration action by capping around the orifice, etc. are done in an ink jet device and during such operations, a great force may be applied not scarcely particularly on the orifice portion or the whole orifice plate, and therefore that such shape and form are preferable for distributing the force as uniform as possible throughout the orifice plate, and yet for the orifice plate to be firmly bonded to the head main body.

Figure 7:
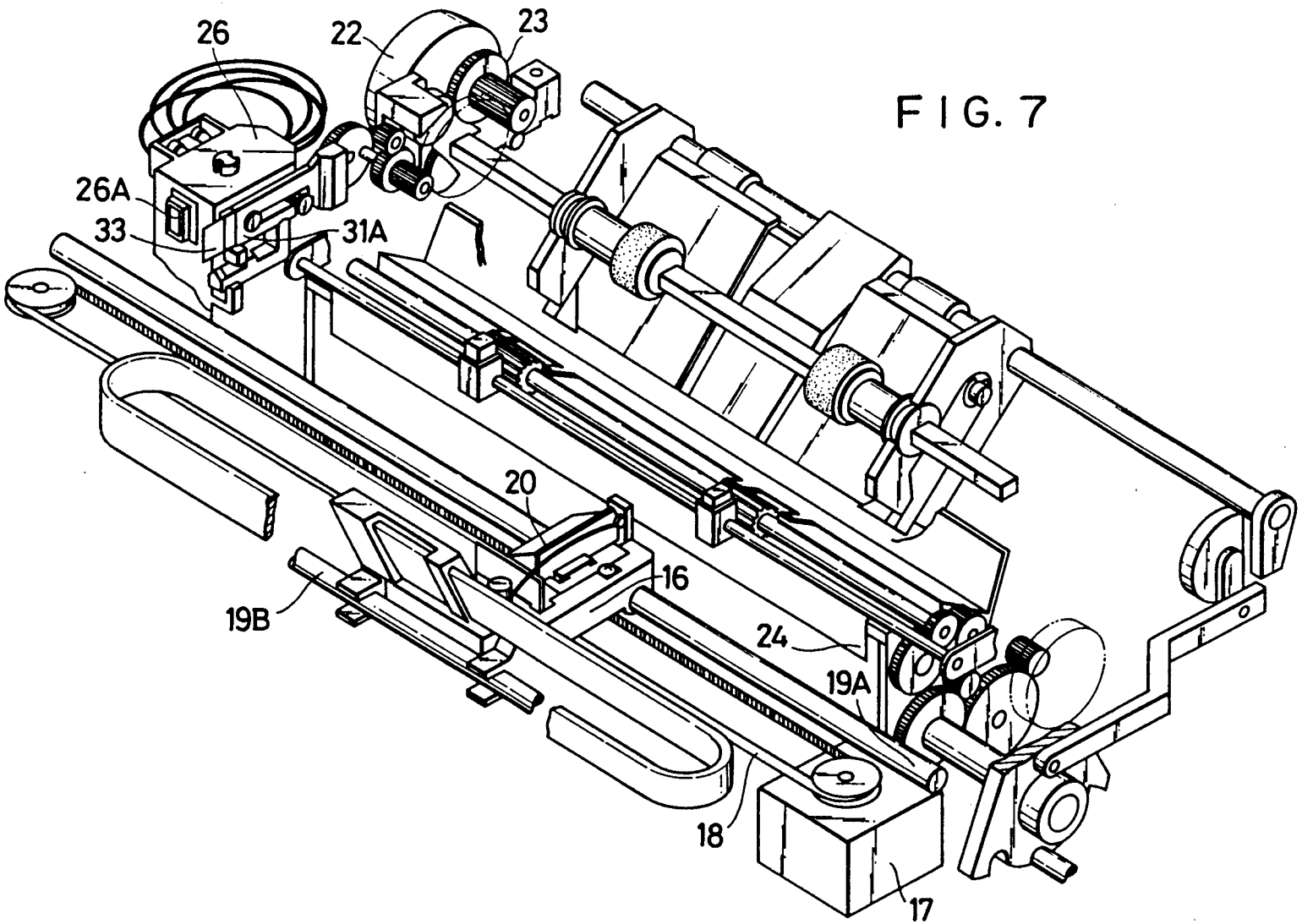
FIG. 7 is a perspective view of appearance showing an example of the pertinent portion of an ink jet device according to the present invention.

FIG. 7 is a perspective view of example of the pertinent portion of an ink jet recording device according to the present invention.

In the Figure, 20 is a recording head equipped with a group of discharge ports for performing ink discharging, the ports being opposed to the recording surface of a recording paper fed onto the platen 24. Numeral 16 is a carriage for holding the recording head 20, joined to a part of the driving belt 18 for transmitting the driving force of the driving motor 17. By making the carriage slidable along two guide shafts 19A, 19B arranged in parallel to each other, reciprocal movement of the recording head 20 over the entire width of the recording paper becomes possible.

Numeral 26 is a head restoring device, and may be positioned at one end of the moving route of the recording head 20, for example, at the position opposed to the home position. By actuating the head restoring device 26 by the driving force of the motor 22 through the transmission mechanism 23, capping of the recording head 20 is performed. In connection with the capping onto the recording head 20 by means of the cap portion 26A of the head restoring device 26, ink aspiration by a suitable aspiration means provided within the head restoring device 26 or ink pressure delivery by means of a suitable pressurization means provided in the ink feeding route to the recording head 20 is performed to discharge ink compulsorily through the discharge port, thereby effecting the discharge restoration treatment such as removal of thickened ink within the ink pathways communicated to the discharge ports. Also, by capping on completion of recording, etc., the recording head can be protected.

Numeral 33 is a blade as the wiping member which is arranged at the side face of the head restoring device 26, and is formed of a silicone rubber. The blade 33 is held in cantilever form on the blade holding member 31A, actuated by the motor 22 and the transmission mechanism 23 similarly as the head restoring device 26, whereby engagement with the discharge surface of the recording head 20 is rendered possible. In this way, at adequate timing during the recording actuation of the recording head 20, or after the discharge restoration treatment by use of the head restoring device 26, the blade 33 is protruded into the moving route of the recording head 20 and wipes off the dew drops, wetting or dust, etc. on the discharge surface of the head 20 as accompanied with movement actuation of the head 20.

The present invention brings about excellent effects particularly in a recording head, recording device of the bubble jet system among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleus boiling corresponding to the recording information on electricity-heat convertors arranged corresponding to the sheets or liquid channels holding liquid (ink), heat energy is generated at the electricity-heat convertors to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of discharging orifice, liquid channel, electricity-heat converter (linear liquid channel or right angle liquid channel) as disclosed in the above-mentioned respective specifications, the constitution by use of U.S. Pat. Nos. 4,558,333 and 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electricity-heat convertors as the discharging portion of the electricity-heat convertor or Japanese Patent Laid-Open Application No. 59-138461 which discloses the constitution having the opening for absorbing pressure wave of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above further effectively.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat convertors or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary stream color such as black, etc., but also a device equipped with at least one of plural different colors or full color by color mixing, whether the recording head may be either integrally constituted or combined in plural number.

The ink jet recording head made by the present invention has orifices and liquid passages communicated to each other, in ideal shape, whereby the ink flow becomes smooth to improve the discharging speed of ink and also makes printing quality more beautiful. Also, the ink jet head according to the present invention can be made by the simple method of working the orifices by progressing the material for orifice plate into the inner portion of the liquid channel.

Furthermore, in the present invention, since a part of the orifice plate intrudes into the ink pathway, the orifice plate and the ink jet head main body are firmly bonded. Accordingly, even when any force is applied onto the orifice plate, peeling off and off-position of the orifice plate from the ink jet head main body are securely prevented. These effects are particularly important to those ink jet apparatuses which are provided with a device for restoring failure of ink discharge of an ink jet head. The reason is that in such ink jet apparatuses wiping of the orifice part and aspiration through capping around the orifice are carried out as described above and the force applied onto the orifice part or the entirety of the orifice plate at that time is especially large.

What is claimed is:

1. A process for preparing an ink jet head, the head having a discharge port plate having a discharge port provided therethrough for discharging ink, and an ink jet head main body having an opening on a face of the main body, the opening provided corresponding to the discharge port, an ink pathway communicated to the opening and an energy generating member for generating energy to be utilized for discharging ink from the discharge port, wherein said main body is bonded to said discharge port plate, said process comprising the steps of:

bonding a plate member which becomes the discharge port plate to the face of the ink jet head main body where the opening is provided;

applying a pressure on at least a portion of the plate member through which the discharge port is to be formed, the portion of the plate member being extruded into the opening of the main body; and forming the discharging port through the plate member which becomes the discharge port plate.

2. The process according to claim 1, wherein said bonding step is performed before said pressurization step.

3. The process according to claim 2, further comprising a heating step of heating the plate member between said bonding step and said pressurization step.

4. The process according to claim 1, wherein said bonding step and said pressurization step are performed at the same time.

5. The process according to claim 1, wherein said discharge port forming step is performed by photolithography.

6. The process according to claim 1, wherein said discharge port forming step is performed by use of a laser beam.

7. The process according to claim 1, wherein the energy generating member comprises an electrothermal transducer which generates heat energy as the discharge energy.

8. An ink jet head including a discharge port plate having a discharge port provided therethrough for discharging ink, and an ink jet head main body having an opening on a face of the main body, the opening provided corresponding to the discharge port, an ink pathway communicated to the opening and an energy generating member for generating energy to be utilized for discharging ink from the discharge port, wherein said main body is bonded to said discharge port plate, said head being formed by a process comprising the steps of:

bonding a plate member which becomes the discharge port plate to the face of the ink jet head main body where the opening is provided;

applying a pressure on at least a portion of the plate member through which the discharge port is to be formed, the portion of the plate member being extruded into the opening of the main body; and forming the discharge port through the plate member which becomes the discharge port plate.

9. An ink jet apparatus including an ink jet head having a discharge port plate having a discharge port provided therethrough for discharging ink, and an ink jet head main body having an opening on a face of the main body, the opening provided corresponding to the discharge port, an ink pathway communicated to the opening and an energy generating member for generating energy to be utilized for discharging ink from the discharge port, wherein said main body is bonded to said discharge port plate, said head being formed by a process comprising the steps of:

bonding a plate member which becomes the discharge port plate to the face of the ink jet head main body where the opening is provided;

applying a pressure on at least a portion of the plate member through which the discharge port is to be formed, the portion of the plate member being extruded into the opening of the main body; and forming the discharge port through the plate member which becomes the discharge port plate.

10. An ink jet apparatus according to claim 18, further comprising:

wiping means for wiping a discharge port portion of said ink jet head.

11. An ink jet apparatus according to claim 9, further comprising:

capping means for capping said discharge port of said ink jet head.

12. An ink jet head comprising:

a discharge port plate through which a discharge port is formed for discharging ink; and an ink jet head main body including an opening provided corresponding to said discharge port, an ink pathway communicated to said opening, and an energy generating member for generating energy to be utilized for discharging ink from said discharge port, said main body being bonded to said discharge port plate, wherein said dishcarge port plate is formed of a film, and at least a part of said discharge port plate, through which said discharge port is to be formed, protrudes into said opening of said ink jet head main body, the protrusion being effected by the application of pressure.

13. The ink jet head according to claim 12, wherein said discharge port plate is formed of an organic resin.

14. The ink jet head according to claim 13, wherein the organic resin has photosensitivity.

15. The ink jet head according to claim 12, wherein said energy generating member comprises electrothermal transducer which generates heat energy as the discharge energy.

16. An ink jet apparatus comprising an ink jet head including a discharge port plate through which a discharge port is formed for discharging ink, and an ink jet head main body including an opening provided corresponding to said discharge port, an ink pathway communicated to said opening, and an energy generating member for generating energy to be utilized for discharging ink from said discharge port, said main body being bonded to said discharge port plate, wherein said discharge port plate is formed of a film, and at least a part of said discharge port plate, through which said discharge port is to be formed, protrudes into said opening of said ink jet head main body, the protrusion being effected by the application of pressure; and wiping means for wiping a discharge port portion of said ink jet head.

17. An ink jet apparatus comprising an ink jet head including a discharge port plate through which a discharge port is formed for discharging ink and an ink jet head main body including an opening provided corresponding to said discharge port, an ink pathway communicated to said opening, and an energy generating member for generating energy to be utilized for discharging ink from said discharge port, said main body being bonded to said discharge port plate, wherein said discharge port plate is formed of a film, and at least a part of said discharge port plate, through which said discharge port is to be formed, protrudes into said opening of said ink jet main body, the protrusion being effected by the application of pressure; and capping means for capping said discharge port of said ink jet head.

18. A discharge port plate for an ink jet head having a discharge orifice, said discharge port plate comprising:

a discharge port portion having a discharge port provided therethrough for discharging ink; and a main body portion, wherein said main body portion of said plate being formed of a film, and said discharge port portion of said plate protruding from said main body portion upon the application of pressure for protrusion into the discharge orifice of the ink jet head.

* * * * *

UNITED STATES PATENT AND TRADEMARK OFFICE
CERTIFICATE OF CORRECTION

PATENT NO. : 5,059,973

DATED : October 22, 1991

INVENTOR(S) : Takashi Watanabe

It is certified that error appears in the above-identified patent and that said Letters Patent is hereby corrected as shown below:

COLUMN 1

Line 35, "reduces" should read --sometimes reduces--.

COLUMN 2

Line 46, "of appearance" should be deleted.

COLUMN 3

Line 56, "in" should read --and--.

COLUMN 4

Line 17, "example" should read --an example--.

COLUMN 5

Line 39, "made" should read --made with--.

UNITED STATES PATENT AND TRADEMARK OFFICE
CERTIFICATE OF CORRECTION

PATENT NO. : 5,059,973

DATED : October 22, 1991

INVENTOR(S) : Takashi Watanabe

It is certified that error appears in the above-identified patent and that said Letters Patent is hereby corrected as shown below:

COLUMN 6

Line 61, "discharging" should read --discharge--.

COLUMN 7

Line 53, "claim 18," should read --claim 9,--.

COLUMN 8

Line 5, "dishcarge" should read --discharge--.
Line 16, "comprises" should read --comprises an--.
Line 19, "comprising" should read --comprising:--.
Line 37, "comprising an" should read --comprising: ¶ an--.

Signed and Sealed this

Thirtieth Day of March, 1993

*Attest:*

STEPHEN G. KUNIN

*Attesting Officer*

*Acting Commissioner of Patents and Trademarks*